US010664000B2

(12) United States Patent
Yamanaka

(10) Patent No.: US 10,664,000 B2
(45) Date of Patent: May 26, 2020

(54) POWER SOURCE CIRCUIT

(71) Applicants: KABUSHIKI KAISHA TOSHIBA, Minato-ku, Tokyo (JP); TOSHIBA ELECTRONIC DEVICES & STORAGE CORPORATION, Minato-ku, Tokyo (JP)

(72) Inventor: Yuji Yamanaka, Kanagawa (JP)

(73) Assignees: KABUSHIKI KAISHA TOSHIBA, Tokyo (JP); TOSHIBA ELECTRONIC DEVICES & STORAGE CORPORATION, Tokyo (JP)

( * ) Notice: Subject to any disclaimer, the term of this patent is extended or adjusted under 35 U.S.C. 154(b) by 0 days.

(21) Appl. No.: 16/275,048

(22) Filed: Feb. 13, 2019

(65) Prior Publication Data

US 2020/0089268 A1 Mar. 19, 2020

(30) Foreign Application Priority Data

Sep. 14, 2018 (JP) ..... 2018-172185

(51) Int. Cl.
*G05F 1/10* (2006.01)
*G05F 3/02* (2006.01)
*G05F 3/26* (2006.01)

(52) U.S. Cl.
CPC ..... *G05F 3/262* (2013.01)

(58) Field of Classification Search
CPC . G05F 3/30; G05F 3/267; G05F 3/262; G05F 3/205; G11C 5/147
USPC ..... 327/77, 539; 323/313
See application file for complete search history.

(56) References Cited

U.S. PATENT DOCUMENTS

| | | | | |
|---|---|---|---|---|
| 5,081,410 | A * | 1/1992 | Wood | G05F 3/30 323/315 |
| 6,828,834 | B2 | 12/2004 | Sivero et al. | |
| 7,148,742 | B2 | 12/2006 | Pan et al. | |
| 7,332,946 | B2 | 2/2008 | Pan et al. | |
| 7,812,649 | B2 * | 10/2010 | Barnett | H03K 17/223 327/143 |
| 8,115,461 | B2 | 2/2012 | Yoshio | |
| 8,508,211 | B1 * | 8/2013 | Anderson | G05F 3/30 323/313 |
| 8,941,437 | B2 | 1/2015 | Nakamoto | |
| 2016/0274617 | A1 * | 9/2016 | Wadhwa | G05F 3/30 |

FOREIGN PATENT DOCUMENTS

| | | | |
|---|---|---|---|
| JP | 2006512632 | A | 4/2006 |
| JP | 4311687 | B2 | 8/2009 |
| JP | 4784841 | B2 | 10/2011 |
| JP | 6048289 | B2 | 12/2016 |

* cited by examiner

*Primary Examiner* — Anh Q Tra
(74) *Attorney, Agent, or Firm* — Holtz, Holtz & Volek PC

(57) ABSTRACT

According to an embodiment, a power source circuit has first, second, and third one-conductivity-type transistors with commonly connected emitters, wherein the first transistor has an emitter area that is N times those of the second and third transistors. The power source circuit outputs a reference voltage that is set by a voltage drop that is caused at a resistance between bases of the first and second transistors and a forward voltage of a PN-junction diode, and outputs a BG_OK signal in response to a potential at a collector of the third transistor.

20 Claims, 6 Drawing Sheets

POWER SOURCE CIRCUIT

CROSS-REFERENCE TO RELATED APPLICATIONS

This application is based upon and claims the benefit of priority from Japanese Patent Application No. 2018-172185, filed on Sep. 14, 2018; the entire contents of which are incorporated herein by reference.

FIELD

Embodiments described herein relate generally to a power source circuit.

BACKGROUND

For a power source circuit that outputs a bandgap reference voltage, a configuration that includes a circuit that outputs a signal that indicates that the bandgap reference voltage is output has conventionally been known. A bandgap reference voltage is used as a reference voltage of a series regulator, a DC/DC converter, or the like. In a case where a signal is output that indicates that a bandgap reference voltage is output even though it is not provided in a desired state, a circuit that receives a voltage from a power source circuit to operate is caused to operate erroneously. Hence, it is desired that a signal that indicates being output is a signal that accurately reflects a state of a bandgap reference voltage that is output by a power source circuit.

DETAILED DESCRIPTION

According to one embodiment, a power source circuit has a first conductivity-type first bipolar transistor that has an emitter, a base, and a collector. The power source circuit has a first conductivity-type second bipolar transistor that has an emitter that has an emitter area that is different from an emitter area of the first bipolar transistor and is commonly connected to the emitter of the first bipolar transistor. The power source circuit has a first conductivity-type third bipolar transistor that has an emitter that has an emitter area that is different from the emitter area of the first bipolar transistor and is commonly connected to the emitter of the first bipolar transistor. The power source circuit has an output voltage setting circuit that has a first resistor that is connected between the base of the first bipolar transistor and a base of the second bipolar transistor and a second resistor that is connected between the base of the second bipolar transistor and a base of the third bipolar transistor. The power source circuit has a PN-junction diode that is connected in a forward direction between the base of the first bipolar transistor and a power source terminal. The power source circuit has a reference voltage output terminal that is connected to the output voltage setting circuit and outputs a reference voltage that is set by a voltage that is a sum of a forward voltage of the PN-junction diode and a voltage that is a predetermined times a voltage drop that is caused at the first resistor. The power source circuit has a detection signal output circuit that outputs a detection signal that indicates that the reference voltage reaches a predetermined threshold voltage in response to a potential at a collector of the third bipolar transistor.

Exemplary embodiments of power source circuit will be explained below in detail with reference to the accompanying drawings. The present invention is not limited to the following embodiments.

First Embodiment

Figure 1:
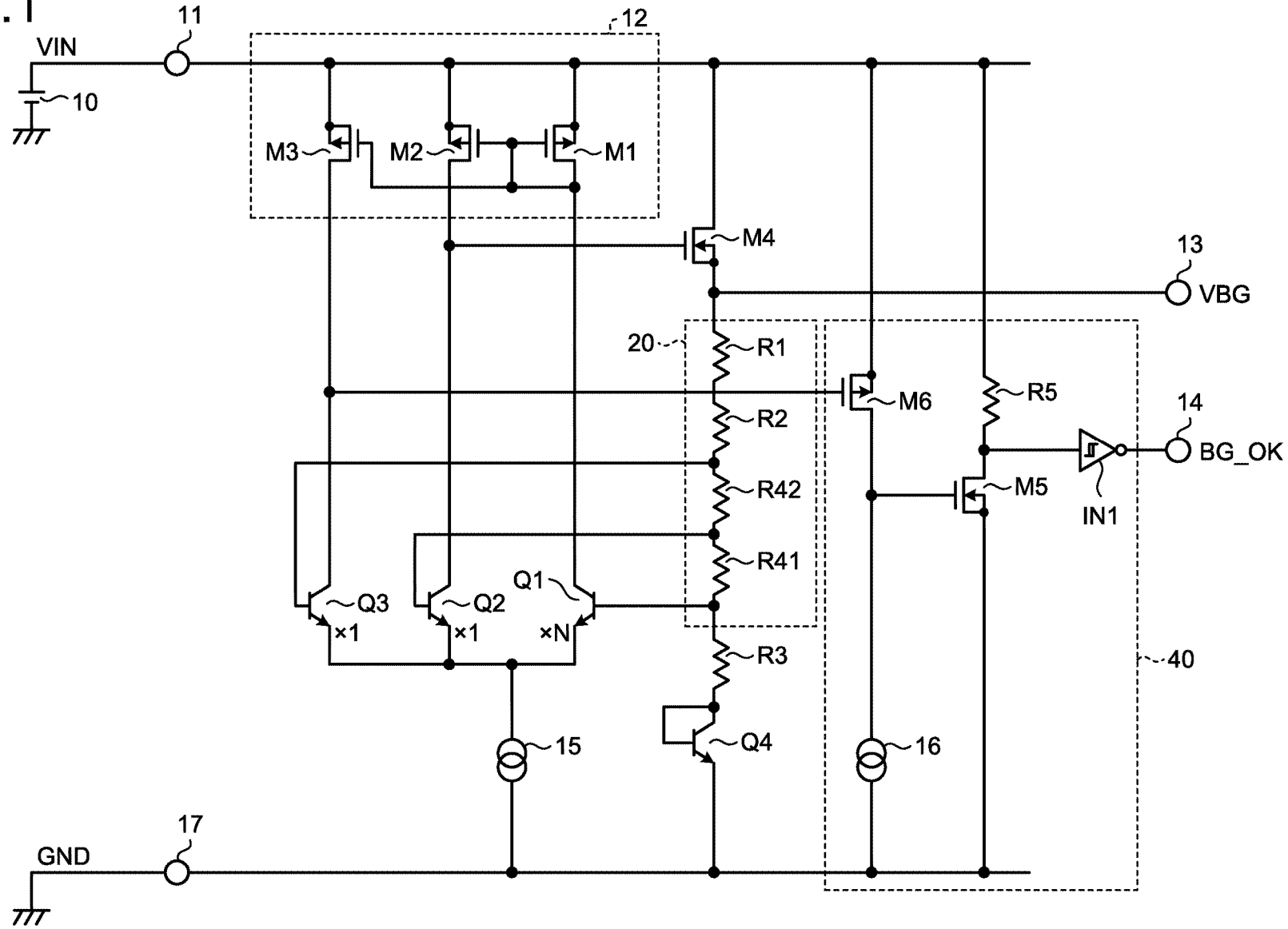
FIG. 1 is an explanatory diagram that illustrates a power source circuit according to a first embodiment.

FIG. 1 is a diagram that illustrates a configuration of a power source circuit according to a first embodiment. A power source circuit according to the present embodiment has three NPN bipolar transistors G1 to Q3 where emitters thereof are commonly connected. Emitters of the transistors Q1 to Q3 are connected to a ground terminal 17 via a current source 15. A ground potential GND is applied to the ground terminal 17.

For example, a ratio of emitter areas of the transistors Q2, Q3 to that of the transistor Q1 is set at 1:N (where N is an arbitrary positive number that is greater than or equal to 1). That is, the transistors Q2 and Q3 have emitters with identical areas and an emitter area of the transistor Q1 has an emitter area that is N times those of the transistors Q2 and Q3. It is possible to set an emitter area by, for example, the number of (non-illustrated) transistors that are connected in parallel and compose each of the transistors Q1 to Q3. For example, the number of transistors that compose the transistor Q1 is N times the number of transistors that compose the transistors Q2 and Q3, so that it is possible to cause a ratio of emitter areas to be N:1.

A series circuit of a resistor R3 and an NPN bipolar transistor Q4 is connected between a base of the transistor Q1 and the ground terminal 17. The transistor Q4 is provided with a base and a collector that are commonly connected to compose a PN-junction diode. The transistor Q4 is connected between a base of the transistor Q1 and the ground terminal 17 in a direction where a forward voltage is generated therein.

An input voltage VIN is applied to a power source terminal 11 by a power source 10. A current mirror circuit 12 is connected between collectors of the transistors Q1 to Q3 and the power source terminal 11. The current mirror circuit 12 has PMOS transistors M1 to M3. The transistor M1 is provided with a drain that is connected to a collector of the transistor Q1 and a source that is connected to the power source terminal 11. That is, a source-drain path that is a main current path of the transistor M1 is connected between the power source terminal 11 and the collector of the transistor Q1.

The transistors M2, M3 are provided with gates that are commonly connected to a gate of the transistor M1. Furthermore, sources of the transistors M2, M3 are connected to the power source terminal 11 and drains thereof are connected to collectors of the transistors Q2, Q3, respectively.

Gates of the transistors M1 to M3 are commonly connected and respective sources are connected to the power source terminal 11, so that gate-source voltages VGS of the transistors M1 to M3 are of identical values. Hence, the current mirror circuit 12 is configured to supply a drain current dependent on a dimension ratio of the transistors M1 to M3 to collectors of the transistors Q1 to Q3. In the present embodiment, dimensions of the collectors of the transistors Q2, Q3 are set so as to be identical, so that drain currents with identical values are supplied to collectors of the transistors Q1 to Q3.

It has an NMOS transistor M4 with a gate that is connected to a collector of the transistor Q2, a drain that is connected to the power supply terminal 11, and a source that is connected to a reference voltage output terminal 13. That is, a source-drain path that is a main current path of the transistor M4 is connected between the power source terminal 11 and the reference voltage output terminal 13.

An output voltage setting circuit 20 is connected between a source of the transistor M4 and a base of the transistor Q1. The output voltage setting circuit 20 has a resistor R41 and a resistor R42 that are connected in series. The resistor R41 is connected between a base of the transistor Q1 and a base of the transistor Q2. The resistor R42 is connected between a base of the transistor Q3 and a base of the transistor Q4. Furthermore, one terminal of the resistor R42 is connected to the reference voltage output terminal 13 via the resistors R2 and R1.

The present embodiment has a detection signal output circuit 40. The detection signal output circuit 40 has a transistor M6 with a gate that is connected to a collector of the transistor Q4, a source that is connected to the power source terminal 11, and a drain that is connected to a current source 16. Conduction of the transistor M6 is controlled by a collector potential of the transistor Q3. Furthermore, the detection signal output circuit 40 has an NMOS transistor M5 with a source that is connected to the ground terminal 17, a gate that is connected to a drain of the transistor M6, and a drain that is connected to the power source terminal 11 via a resistor R5 and connected to a detection signal output terminal 14.

A differential voltage ΔVbe between base-emitter voltages of the transistors Q1 and Q2 is applied to the resistor R41. In a state where transistors Q1 and Q2 are turned on completely and stabilized, a differential voltage ΔVbe is expressed by the following formula (1).

$$\Delta Vbe = k \times T/q \times \ln N [V] \tag{1}$$

In formula (1), k is a Boltzmann constant ($1.3807\times10^{-23}$ [$JK^{-1}$]), T is an absolute temperature [K], q is a charge of an electron ($1.602177\times10^{-19}$ [C]), ln is a natural logarithm, and N is a ratio of emitter areas of the transistors Q1 and Q2.

For example, if a ratio of emitter areas N is "8", ΔVbe in formula (1) is about 54 mV at an ordinary temperature. In such a case, in a state where a voltage drop at the resistor R41 is less than such a differential voltage ΔVbe, the transistor Q2 is not provided in a complete on-state. Hence, a drain potential of the transistor M2, that is, a gate potential of the transistor M4 rises with an input voltage VIN.

The transistor M4 is turned on as a gate potential exceeds a threshold voltage. Thereby, the output voltage setting circuit 20 is connected to the power source terminal 11 via the transistor M4. A voltage at the reference voltage output terminal 13 that is connected to the output voltage setting circuit 20 rises with a rise in a drain voltage of the transistor M4.

As a voltage drop at the resistor R41 reaches a differential voltage ΔVbe as expressed in formula (1) with a rise in an input voltage VIN, the transistor Q2 is provided in a complete on-state. That is, stabilization is provided in a state where a differential voltage ΔVbe that is set by a ratio of emitter areas N of the transistors Q1 and Q2 is generated at the resistor R41.

At a time of a state where a voltage drop at the resistor R41 is stabilized by a differential voltage ΔVbe, a bandgap output voltage VBG at the reference voltage output terminal 13 is expressed by the following formula (2).

$$VBG = Vbe(Q4) + \frac{k \times T}{q} \times \ln N \times \frac{(R1 + R2 + R3 + R41 + R42)}{R41} [V] \tag{2}$$

Herein, Vbe(Q4) represents a forward voltage of the transistor Q4. Additionally, R1, R2, R3, R41, and R42 in formula (2) conveniently represent resistance values of the corresponding resistors R1, R2, R3, R41, and R42, respectively. Hereinafter, a similar matter applies to each mathematical formula.

A current that is obtained by dividing a voltage drop that corresponds to a differential voltage ΔVbe by a resistance value of the resistor R41 flows through the output voltage setting circuit 20 to cause voltage drops at the respective resistors R1, R2, R3, R41, and R42.

Therefore, in the present embodiment, as expressed in formula (2), a bandgap output voltage VBG is set by a sum of a forward voltage Vbe(Q4) of the transistor Q4 and a voltage that is predetermined times a differential voltage ΔVbe as expressed in formula (1) depending on resistance values of respective resistors of the output voltage setting circuit 20 and the resistor R3.

Furthermore, a temperature coefficient of a bandgap output voltage VBG is expressed by the following formula (3).

$$\frac{\partial(VBG)}{\partial T} = \frac{\partial Vbe(Q4)}{\partial T} + \frac{k}{q} \times \ln N \times \frac{(R1 + R2 + R3 + R41 + R42)}{R41} [V/^\circ\ C.] \tag{3}$$

A temperature coefficient ∂Vbe(Q4)/∂T of Vbe(Q4) indicates a negative temperature characteristic and is, for example, −1.8 m(V/° C.). Therefore, a value of a second term of formula (3) is adjusted so that it is possible to cause a temperature coefficient of a bandgap output voltage VBG to be 0 (V/° C.).

A value of a second term of formula (2) is a voltage that has a value that is equal to a voltage Vbe(Q4) and a positive temperature coefficient, so that a temperature coefficient of a bandgap output voltage VBG is 0 (V/° C.). For example, Vbe(Q4) is generally about 0.6 V, so that it is possible to configure a power source circuit that outputs a bandgap output voltage VBG with a voltage that is twice Vbe(Q4) or about 1.25 V and a temperature coefficient that is 0 (V/° C.) as a bandgap output voltage VBG.

Serial connection of the resistors R41 and R42 is connected between bases of the transistors Q1 and Q3. Therefore, in a state where a voltage that is a sum of voltage drops at the resistors R41 and R42 is lower than a voltage of formula (1) as described above, the transistor Q3 is not provided in a complete on-state. Therefore, a collector potential of the transistor Q3, that is, a gate potential of the transistor M6 is provided in a high state, so that the transistor M6 is provided in an off-state.

As a voltage that is a sum of voltage drops at the resistors R41 and R42 reaches a differential voltage ΔVbe as expressed in figure (1), the transistor Q3 is provided in a complete on-state and a gate potential of the transistor M6 is lowered. Thereby, the transistor M6 is turned on.

As the transistor M6 is turned on, a gate potential of the transistor M5 is raised to be turned on. Thereby, an input of an inverter IN1 is provided at an L level and a detection signal BG_OK at an H level is output from the detection signal output terminal 14.

A detection threshold voltage Vs(BG_OK) of the reference voltage output terminal 13 at a time when a voltage that is a sum of voltage drops at the resistors R41 and R42 reaches a differential voltage ΔVbe as expressed in figure (1) is expressed by the following formula (4). Hereinafter, Vs(BG_OK) will be referred to as a detection threshold voltage.

$$Vs(\text{BG_OK}) = Vbe(Q4) + \frac{k \times T}{q} \times \ln N \times \frac{(R1 + R2 + R3 + R41 + R42)}{(R41 + R42)} [V] \quad (4)$$

Formula (3) and formula (4) are different only in a denominator of a fraction part of a resistor in a second term. Therefore, it is possible to set a setting ratio of a detection threshold voltage Vs(BG_OK) arbitrarily by values of the resistor R41 and the resistor R42. For example, R42=R41× 0.125 is provided, so that it is possible to set a detection threshold voltage Vs(BG_OK) at about 1.18 (V). That is, at a time when a voltage at the reference voltage output terminal 13 reaches a voltage that is 94.4% of about 1.25 V that is a set bandgap voltage, a detection signal BG_OK at an H level is output. Therefore, it is possible to provide a power source circuit that accurately reflects a state of a bandgap output voltage VBG to be output and outputs a detection signal BG_OK.

Furthermore, it is possible to cause a temperature coefficient of a detection threshold voltage Vs(BG_OK) to be a value that is substantially identical to that of a temperature coefficient of a bandgap output voltage VBG, by adjustment of resistance values of the resistors R41 and R42. Therefore, a temperature coefficient of a bandgap output voltage VBG is set at about 0 (V/° C.), so that it is possible to cause a temperature coefficient of a detection threshold voltage Vs(BG_OK) to be also about 0 (V/° C.).

Therefore, according to the present embodiment, it is possible to output a bandgap output voltage VBG with a temperature coefficient of about 0 (V/° C.) and it is possible to cause a temperature coefficient of a detection threshold voltage Vs(BG_OK) to be also about 0 (V/° C.). Hence, it is possible to provide a power source circuit that outputs a detection signal BG_OK that accurately reflects a state of a bandgap output voltage VBG and is stable against a temperature change.

Figure 2:
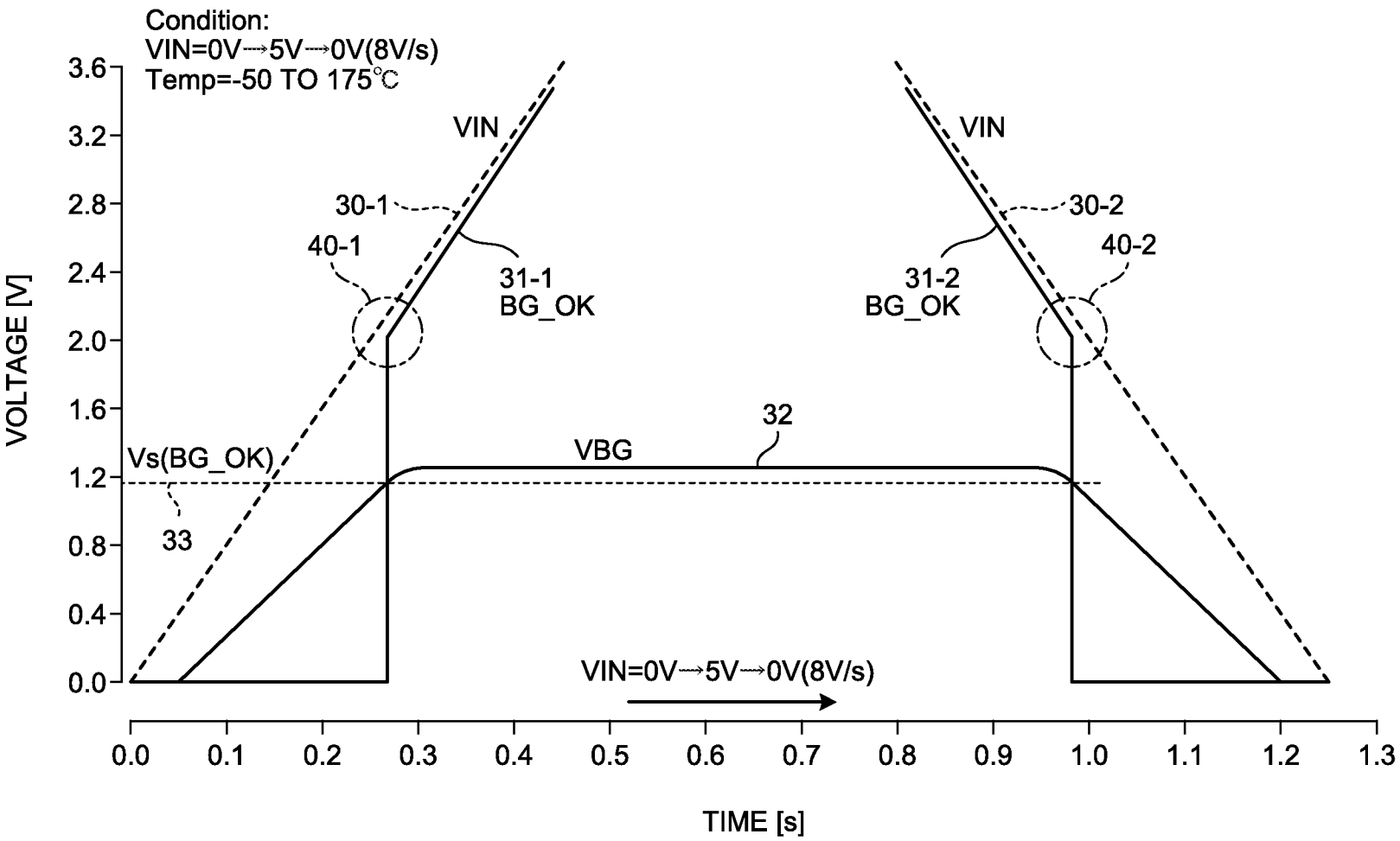
FIG. 2 is a diagram that illustrates a result of simulation of a power source circuit according to the first embodiment.

FIG. 2 is a diagram that illustrates a result of simulation of a power source circuit according to the first embodiment. A horizontal axis indicates a time (S) and a vertical axis indicates a voltage (V). A bandgap output voltage VBG and a detection signal BG_OK in a case where an input voltage VIN is raised from 0 V to 5 V and lowered to 0 V again at a temperature within a range of −50° C. to 175° C. are illustrated. At a time when a bandgap output voltage VBG (32) reaches a detection threshold voltage Vs(BG_OK) as represented by 33 with a rise in an input voltage VIN as represented by 30-1, a detection signal BG_OK (31-1) is changed to an H level. A temperature coefficient of a detection threshold voltage Vs(BG_OK) is set at about 0 (V/° C.), so that a variation in a temperature change at a rise where a detection signal BG_OK is at an H level is small as represented by 40_1. Additionally, the inverter IN1 is biased by an input voltage VIN, so that a voltage of a detection signal BG_OK at an H level rises with a rise in the input voltage VIN.

A bandgap output voltage VBG is stable in a state where a voltage drop at the resistor R41 is a differential voltage ΔVbe, that is, about 54 mV, and indicates a stable value of voltage against a temperature change.

In a case where an input voltage VIN is lowered from 5 V to 0 V as indicated by a broken line 30_2, a voltage of a detection signal BG_OK at an H level as indicated by a solid line 31_2 is lowered. As a sum of voltage drops at the resistors R41 and R42 is less than a differential voltage ΔVbe, the transistor Q3 is provided in an off-state and the transistor M6 is turned off, so that a detection signal BG_OK is provided at an L level. Even in a case where an input voltage VIN is lowered, a variation in a temperature change at a fall of a detection signal BG_OK is suppressed as represented by 40_2.

Figure 3:
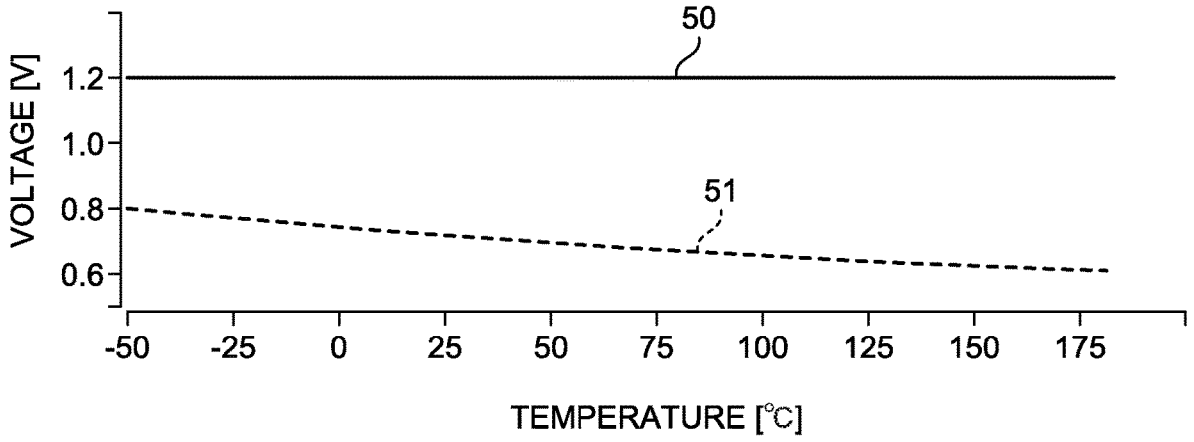
FIG. 3 is a diagram that illustrates a result of simulation where a temperature characteristic in the first embodiment is compared with a conventional power source circuit.
Figure 4:
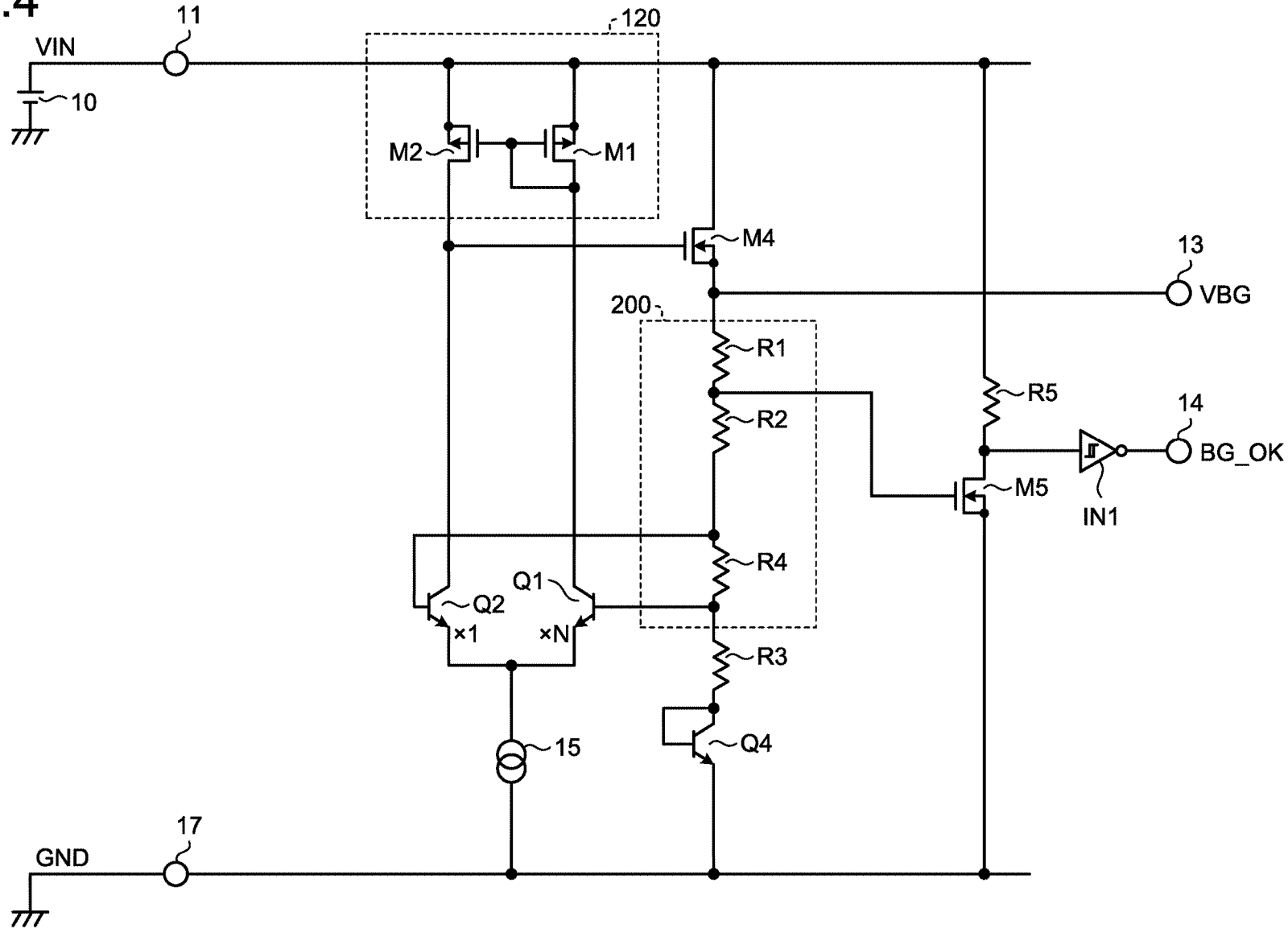
FIG. 4 is a diagram that illustrates a conventional power source circuit that is used for comparison.

FIG. 3 illustrates a temperature change of a detection threshold voltage Vs(BG_OK) in the first embodiment as comparison with a conventional power source circuit as illustrated in FIG. 4. A conventional power source circuit has transistors Q1, Q2 where emitters thereof are commonly connected, and a current mirror circuit 120. One terminal of a resistor R4 of an output voltage setting circuit 200 is connected to a base of the transistor Q1 and the other terminal thereof is connected to a base of the transistor Q2. The output voltage setting circuit 200 includes a transistor M5 with a gate that is connected to a connection point of resistors R1 and R2. The transistor M5 is turned on at a time when a gate potential reaches a threshold voltage, for example, 0.6V, so that a detection signal BG_OK at an H level is output from a detection signal output terminal 14.

In FIG. 3, a solid line 50 indicates a power source circuit according to the first embodiment and a broken line 51 indicates a conventional power source circuit as illustrated in FIG. 4. In the first embodiment, it is possible to set a temperature coefficient of a detection threshold voltage Vs(BG_OK) at about 0 (V/° C.) similarly to that of a bandgap output voltage VBG. Therefore, a power source circuit according to the first embodiment indicates a value of a detection threshold voltage that is stable against a temperature change as compared with a conventional power source circuit.

Second Embodiment

Figure 5:
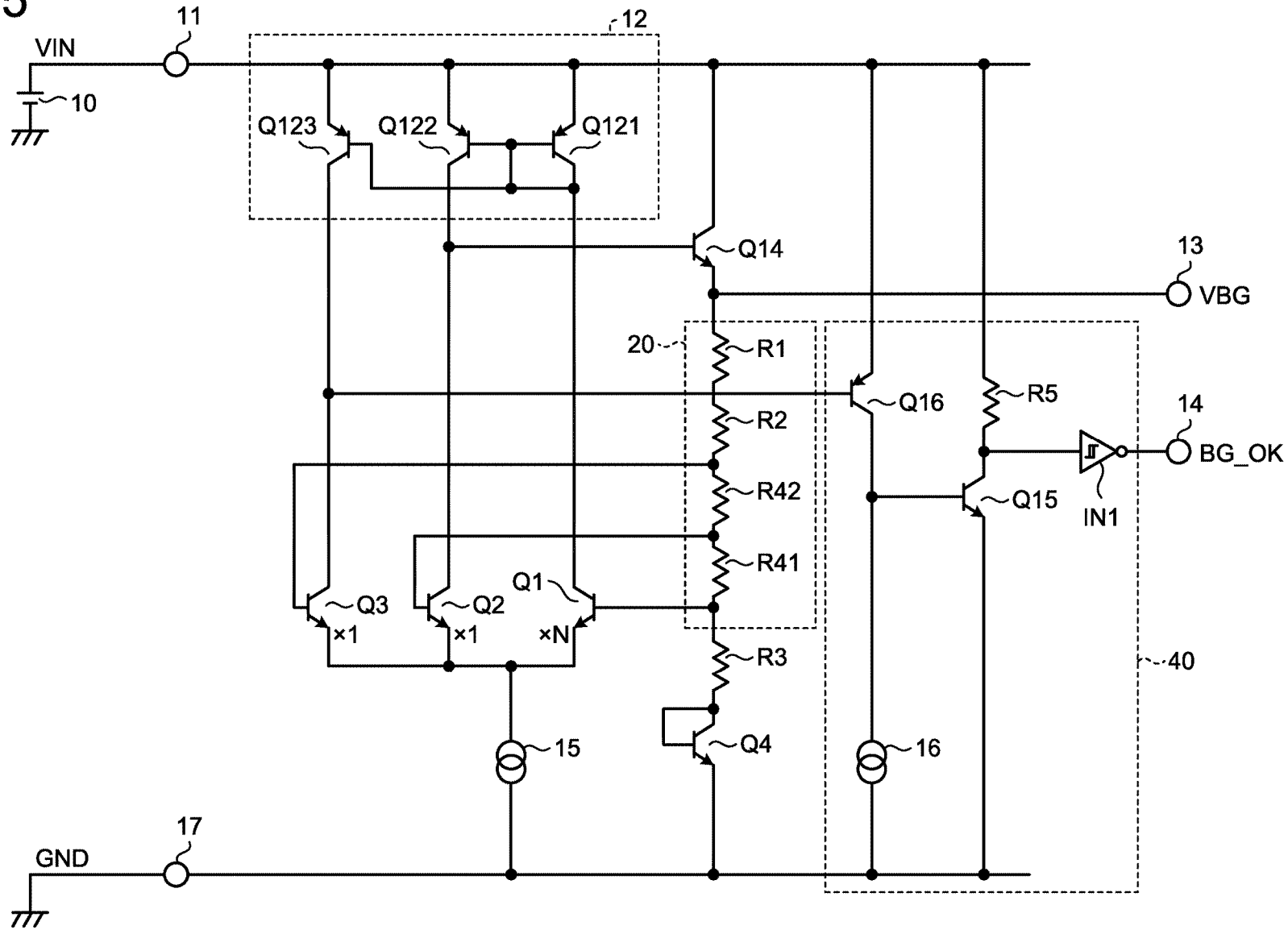
FIG. 5 is a diagram that illustrates a power source circuit according to a second embodiment.

FIG. 5 is a diagram that illustrates a power source circuit according to a second embodiment. An identical sign is provided to a component that corresponds to that of the first embodiment and a redundant description is executed only in a case of need. Hereinafter, a similar matter applies. A power source circuit according to the present embodiment has a current mirror circuit 12 that is composed of PNP transistors Q121, Q122, Q123.

The present embodiment has an NPN transistor Q14. That is, an emitter-collector path that is a main current path of the transistor Q14 is connected between a power source terminal 11 and a reference voltage output terminal 13. As a collector potential of a transistor Q2 is higher than a threshold voltage of the transistor Q14, the transistor Q14 is turned on. Thereby, an output voltage setting circuit 20 is connected to the power source terminal 11 via the transistor Q14, and a bandgap output voltage VBG of the reference voltage output terminal 13 rises with a rise in an emitter voltage of the transistor Q14.

A detection signal output circuit 40 according to the present embodiment has a PNP transistor Q16. The transistor Q16 is provided with a base that is connected to a collector of a transistor Q3, an emitter that is connected to the power source terminal 11, and a collector that is connected to a current source 16.

Furthermore, the detection signal output circuit 40 has an NPN transistor Q15. The transistor Q15 is provided with an emitter that is connected to a ground terminal 17 and a collector that is connected to the power source terminal 11 via a resistor R5 and a detection signal output terminal 14.

As a sum of voltage drops at resistors R41 and R42 reaches a differential voltage ΔVbe as expressed by formula (1) similarly to that of the first embodiment, the transistor Q3 is provided in a complete on-state and a base potential of the transistor Q16 is lowered to be turned on.

As the transistor Q16 is turned on, a base potential of the transistor Q15 is raised to be turned on. Thereby, an input of an inverter IN1 is provided at an L level, so that an output thereof is provided at an H level. Hence, a detection signal BG_OK at an H level is output from the detection signal output terminal 14.

In a state where a voltage drop at the resistor R41 is a differential voltage ΔVbe and transistors Q1 and Q2 are turned on completely and stabilized, an operation with a bandgap output voltage VBG that is set by formula (2) or an operation with a voltage of a detection threshold voltage Vs(BG_OK) that is capable of being set by formula (4) depending on values of the resistors R41, R42 is identical to that of the first embodiment.

Relative errors or offsets of the transistors Q121, Q122, Q123 are generally small as compared with those of transistors M1, M2, M3. Therefore, in the present embodiment, it is possible to improve accuracy of the current mirror circuit 12, that is, accuracy of a ratio of currents that are supplied to transistors Q1, Q2, Q4.

Third Embodiment

Figure 6:
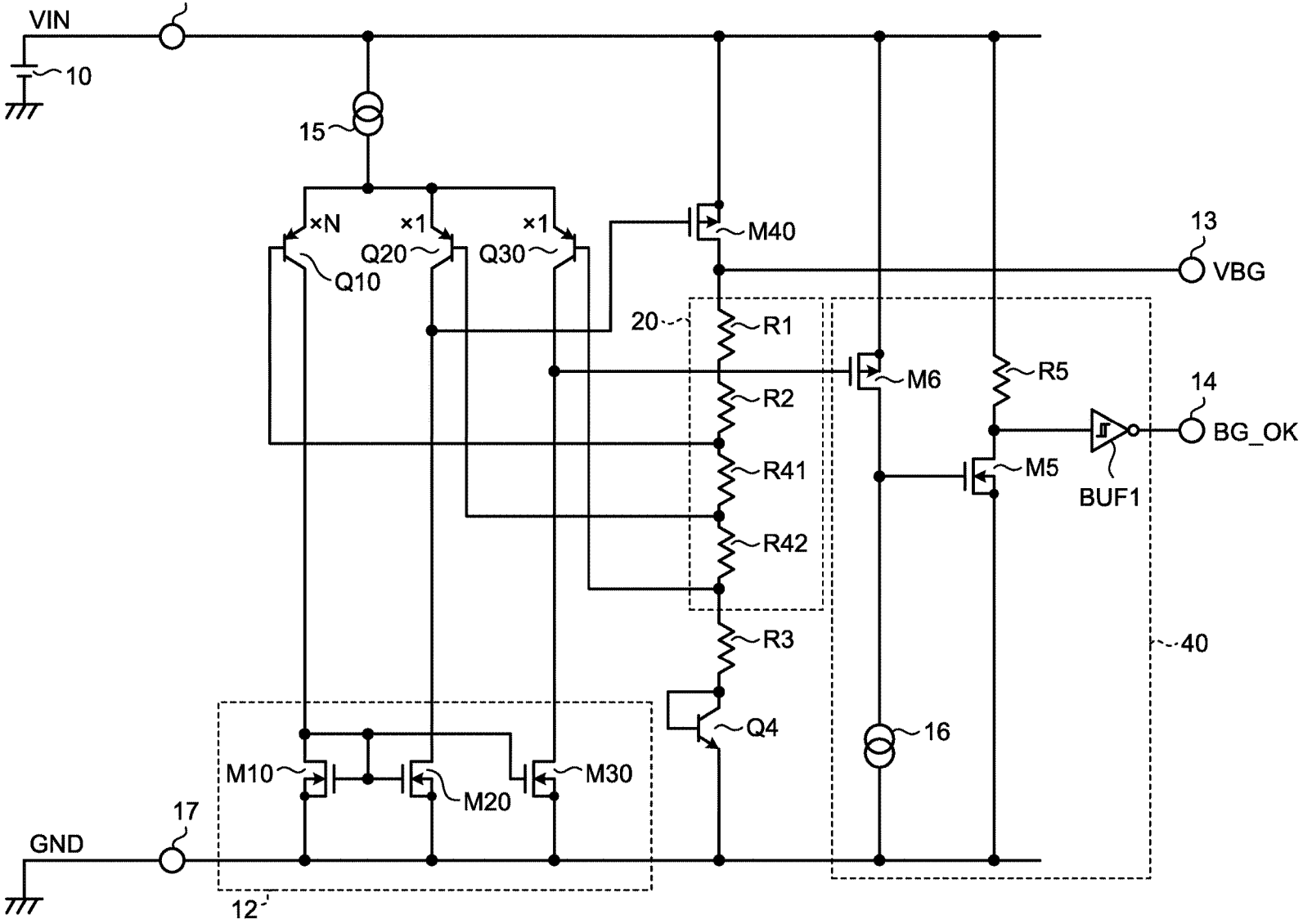
FIG. 6 is a diagram that illustrates a power source circuit according to a third embodiment.

FIG. 6 illustrates a power source circuit according to a third embodiment. A power source circuit according to the present embodiment has PNP transistors Q10, Q20, and Q30 where emitters thereof are commonly connected, instead of the transistors Q1 to Q3 in the first embodiment. The transistor Q10 has an emitter area that is N times those of the transistors Q20, Q30. The number of (non-illustrated) transistors that are connected in parallel and compose the transistor Q10 is N times the number of (non-illustrated) transistors that compose each of the transistors Q20, Q30, so that it is possible to cause an emitter area of the transistor Q10 to be N times.

Drains of NMOS transistors M10, M20, and M30 that compose a current mirror circuit 12 are connected to collectors of the transistors Q10, Q20, and Q30.

An output voltage setting circuit 20 according to the present embodiment has a resistor R41 that is connected between a base of the transistor Q10 and a base of the transistor Q20 and a resistor R42 that is connected between a base of the transistor Q20 and a base of the transistor Q30.

The present embodiment has a transistor M40 with a gate that is connected to a collector of the transistor Q20, a source that is connected to a power source terminal 11, and a drain that is connected to a reference voltage output terminal 13 and an output voltage setting circuit 20.

At a time in a state where an input voltage VIN is low, a gate potential of the transistor M40 is provided at an L level to be turned on. Thereby, a voltage drop is caused by the output voltage setting circuit 20, so that a bandgap output voltage VBG is raised.

As a sum of voltage drops at the resistors R41 and R42 reaches a differential voltage ΔVbe with a rise in an input voltage VIN, the transistor Q30 is provided in a complete on-state and a gate potential of a transistor M6 is raised. Thereby, the transistor M6 is turned off.

As the transistor M6 is turned off, a gate potential of a transistor M5 is lowered to be turned off. Thereby, an input of a buffer BUF1 is provided at an H level, so that an output thereof is provided at an H level. Hence, a detection signal BG_OK at an H level is output from a detection signal output terminal 14.

A detection threshold voltage Vs(BG_OK) at a time when a sum of voltage drops at the resistors R41 and R42 reaches a differential voltage ΔVbe is expressed by formula (4) as already described.

As a voltage drop at the resistor R41 is a differential voltage ΔVbe with a rise in an input voltage VIN, the transistor Q20 is provided in an on-state and a gate potential of the transistor M40 is controlled by a negative feedback operation. Thereby, stabilization is provided in a state where collector currents of the transistors Q10 and Q20, that is, drain currents of the transistors M10 and M20 are equal to each other. At a time of such a stabilized state, a bandgap output voltage VBG is expressed by formula (2) as already described.

In the present embodiment, the transistors Q10, Q20, and Q30 where emitters thereof are commonly connected are included and the transistor M40 is turned on in a state where an input voltage VIN is low, so that activation at a low voltage is possible. Furthermore, variations in base-emitter voltages Vbe of the transistors Q10, Q20, Q30 are generally small as compared with those of the transistors Q1 to Q3, so that it is possible to suppress a variation in a bandgap output voltage VBG.

Additionally, although an embodiment as already described is configured to include a current mirror circuit 12 connected to collectors of the transistors Q1 to Q3 or transistors Q010, Q20, Q30 where emitters thereof are commonly connected, a configuration may be provided in such a manner that connection between respective collectors of the transistors Q1 to Q3 or transistors Q10, Q20, Q30 and a power source terminal is provided by resistors, instead of the current mirror circuit 12.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A power source circuit, comprising:

a first conductivity-type first bipolar transistor that has an emitter, a base, and a collector;

a first conductivity-type second bipolar transistor that has an emitter that has an emitter area that is different from an emitter area of the first bipolar transistor and is commonly connected to the emitter of the first bipolar transistor;

a first conductivity-type third bipolar transistor that has an emitter that has an emitter area that is different from the emitter area of the first bipolar transistor and is commonly connected to the emitter of the first bipolar transistor;

an output voltage setting circuit that has a first resistor that is connected between the base of the first bipolar transistor and a base of the second bipolar transistor and a second resistor that is connected between the base of the second bipolar transistor and a base of the third bipolar transistor;

a PN-junction diode that is connected in a forward direction between the base of the first bipolar transistor and a power source terminal;

a reference voltage output terminal that is connected to the output voltage setting circuit and outputs a reference voltage that is set by a voltage that is a sum of a forward voltage of the PN-junction diode and a voltage that is a predetermined times a voltage drop that is caused at the first resistor; and a detection signal output circuit that outputs a detection signal that indicates that the reference voltage reaches a predetermined threshold voltage in response to a potential at a collector of the third bipolar transistor.

2. The power source circuit according to claim 1, wherein the emitter area of the second bipolar transistor is identical to the emitter area of the third bipolar transistor and the emitter area of the first bipolar transistor is N times the emitter areas of the second bipolar transistor and the third bipolar transistor, where N is an arbitrary positive number that is greater than 1.

3. The power source circuit according to claim 1, comprising a current mirror circuit that is connected to collectors of the first, second, and third bipolar transistors.

4. The power source circuit according to claim 1, wherein the detection signal output circuit includes a switching transistor with a control electrode that is connected to a collector of the third bipolar transistor and outputs the detection signal depending on conduction of the switching transistor.

5. The power source circuit according to claim 1, wherein the reference voltage is set at a voltage that is twice the forward voltage of the PN-junction diode.

6. The power source circuit according to claim 1, wherein each of the first, second, and third bipolar transistors includes an NPN bipolar transistor.

7. The power source circuit according to claim 1, wherein each of the first, second, and third bipolar transistors includes a PNP bipolar transistor.

8. The power source circuit according to claim 1, wherein the PN-junction diode has a configuration where a base and a collector of a first conductivity-type bipolar transistor are commonly connected.

9. The power source circuit according to claim 1, comprising a switching transistor with a control electrode that is connected to a collector of the second bipolar transistor and a main current path that is connected between the power source supply terminal and the reference voltage output terminal.

10. The power source circuit according to claim 1, wherein a resistance value of the second resistor has a value that is greater than a resistance value of the first resistor.

11. A power source circuit, comprising:

an input terminal where a power source voltage is applied thereto;

a ground terminal where a ground potential is applied thereto;

a first NPN bipolar transistor that has an emitter, a base, and a collector;

a second NPN bipolar transistor that has an emitter that has an emitter area that is different from an emitter area of the first NPN bipolar transistor and is commonly connected to the emitter of the first NPN bipolar transistor;

a third NPN bipolar transistor that has an emitter that has an emitter area that is different from the emitter area of the first NPN bipolar transistor and is commonly connected to the emitter of the first NPN bipolar transistor;

an output voltage setting circuit that has a first resistor that is connected between the base of the first NPN bipolar transistor and a base of the second NPN bipolar transistor and a second resistor that is connected between the base of the second NPN bipolar transistor and a base of the third NPN bipolar transistor;

a PN-junction diode that is connected in a forward direction between the base of the first NPN bipolar transistor and the ground terminal;

a reference voltage output terminal that is connected to the output voltage setting circuit and outputs a reference voltage that is set by a voltage that is a sum of a forward voltage of the PN-junction diode and a voltage that is a predetermined times a voltage drop that is caused at the first resistor; and a detection signal output circuit that outputs a detection signal that indicates that the reference voltage reaches a predetermined threshold voltage in response to a potential at a collector of the third NPN bipolar transistor.

12. The power source circuit according to claim 11, wherein the emitter area of the second NPN bipolar transistor is identical to the emitter area of the third NPN bipolar transistor and the emitter area of the first NPN bipolar transistor is N times the emitter areas of the second NPN bipolar transistor and the third NPN bipolar transistor, where N is an arbitrary positive number that is greater than 1.

13. The power source circuit according to claim 11, comprising a current mirror circuit that is connected between collectors of the first, second, and third NPN bipolar transistors and the power source terminal.

14. The power source circuit according to claim 11, wherein the detection signal output circuit includes a switching transistor with a control electrode that is connected to a collector of the third NPN bipolar transistor and outputs the detection signal depending on conduction of the switching transistor.

15. The power source circuit according to claim 11, wherein the reference voltage is set at a voltage that is twice the forward voltage of the PN-junction diode.

16. A power source circuit, comprising:

an input terminal where a power source voltage is applied thereto;

a ground terminal where a ground potential is applied thereto;

a first PNP bipolar transistor that has an emitter, a base, and a collector;

a second PNP bipolar transistor that has an emitter that has an emitter area that is different from an emitter area of the first PNP bipolar transistor and is commonly connected to the emitter of the first PNP bipolar transistor;

a third PNP bipolar transistor that has an emitter that has an emitter area that is different from the emitter area of the first PNP bipolar transistor and is commonly connected to the emitter of the first PNP bipolar transistor;

an output voltage setting circuit that has a first resistor that is connected between the base of the first PNP bipolar transistor and a base of the second PNP bipolar transistor and a second resistor that is connected between the base of the second PNP bipolar transistor and a base of the third PNP bipolar transistor;

a PN-junction diode that is connected in a forward direction between the base of the first PNP bipolar transistor and the ground terminal;

a reference voltage output terminal that is connected to the output voltage setting circuit and outputs a reference voltage that is set by a voltage that is a sum of a forward voltage of the PN-junction diode and a voltage that is a predetermined times a voltage drop that is caused at the first resistor; and a detection signal output circuit that outputs a detection signal that indicates that the reference voltage reaches a predetermined threshold voltage in response to a potential at a collector of the third PNP bipolar transistor.

17. The power source circuit according to claim 16, wherein the emitter area of the second PNP bipolar transistor is identical to the emitter area of the third PNP bipolar transistor and the emitter area of the first PNP bipolar transistor is N times the emitter areas of the second PNP bipolar transistor and the third PNP bipolar transistor, where N is an arbitrary positive number that is greater than 1.

18. The power source circuit according to claim 16, comprising a current mirror circuit that is connected between collectors of the first, second, and third PNP bipolar transistors and the ground terminal.

19. The power source circuit according to claim 16, wherein the detection signal output circuit includes a switching transistor with a control electrode that is connected to a collector of the third PNP bipolar transistor and outputs the detection signal depending on conduction of the switching transistor.

20. The power source circuit according to claim 16, wherein the reference voltage is set at a voltage that is twice the forward voltage of the PN-junction diode.

* * * * *